US011655716B2

(12) United States Patent
Lee et al.

(10) Patent No.: US 11,655,716 B2
(45) Date of Patent: May 23, 2023

(54) COOLING STRUCTURE FOR TRAILING EDGE OF TURBINE BLADE

(71) Applicant: DOOSAN ENERBILITY CO., LTD., Changwon (KR)

(72) Inventors: Chang Yong Lee, Sejong (KR); Hyung Hee Cho, Seoul (KR); JeongJu Kim, Seongnam (KR); Seungyeong Choi, Seoul (KR); Hee Seung Park, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/381,313

(22) Filed: Jul. 21, 2021

(65) Prior Publication Data

US 2022/0127964 A1 Apr. 28, 2022

(30) Foreign Application Priority Data

Oct. 23, 2020 (KR) ..... 10-2020-0137964

(51) Int. Cl.
*F01D 5/18* (2006.01)

(52) U.S. Cl.
CPC ..... *F01D 5/186* (2013.01); *F05D 2220/32* (2013.01); *F05D 2240/24* (2013.01);
(Continued)

(58) Field of Classification Search
CPC ..... F01D 5/186; F01D 5/187; F01D 5/188; F01D 5/189; F05D 2260/22141;
(Continued)

(56) References Cited

U.S. PATENT DOCUMENTS 8,591,189 B2 11/2013 Correia
2006/0099074 A1* 5/2006 Kopmels ..... F01D 5/186 416/97 R (Continued)

FOREIGN PATENT DOCUMENTS

JP H05 014502 U 2/1993
JP 2002221005 A 8/2002

(Continued)

OTHER PUBLICATIONS

KR OA dated Mar. 20, 2022.
KR Decision to Grant, dated Sep. 8, 2022.

*Primary Examiner* — Richard A Edgar
*Assistant Examiner* — Michael K. Reitz
(74) *Attorney, Agent, or Firm* — Harvest IP Law LLP

(57) ABSTRACT

A cooling structure for a trailing edge of a turbine blade is provided. The cooling structure for the trailing edge of the turbine blade comprising an airfoil shaped blade part including a leading edge, a trailing edge, a pressure surface and a suction surface connecting the leading edge and the trailing edge, and a cavity channel formed in the blade part and through which a cooling fluid flows, the cooling structure including slots and lands arranged alternately on the trailing edge along a span direction of the pressure surface by cutting a portion of the pressure surface, the slots communicating with the cavity channel and defined by adjacent lands where the pressure surface remains, wherein a pin-fin structure is disposed in the cavity channel on an upstream side of the slot, and wherein the cooling fluid is introduced through a micro-channel formed inside the pin-fin structure and is discharged through film cooling holes formed in the pressure surface.

18 Claims, 7 Drawing Sheets

(52) U.S. Cl.
CPC .. *F05D 2240/304* (2013.01); *F05D 2260/202* (2013.01); *F05D 2260/22141* (2013.01)

(58) Field of Classification Search
CPC ..... F05D 2260/202; F05D 2260/204; F05D 2240/304
See application file for complete search history.

(56) References Cited

U.S. PATENT DOCUMENTS

| | | | | |
|---|---|---|---|---|
| 2007/0128034 | A1* | 6/2007 | Lee | F01D 5/187 416/97 R |
| 2009/0003988 | A1 | 1/2009 | Campbell | |
| 2012/0201653 | A1* | 8/2012 | Moga | F01D 5/187 415/115 |
| 2019/0040745 | A1* | 2/2019 | Clark | F01D 9/065 |

FOREIGN PATENT DOCUMENTS

| | | | |
|---|---|---|---|
| KR | 1020130116323 | A | 10/2013 |
| KR | 20170052768 | A | 5/2017 |
| KR | 1020180101305 | A | 9/2018 |

* cited by examiner

COOLING STRUCTURE FOR TRAILING EDGE OF TURBINE BLADE

CROSS REFERENCE TO RELATED APPLICATION

This application claims priority to Korean Patent Application No. 10-2020-0137964, filed on Oct. 23, 2020, the disclosure of which is incorporated herein by reference in its entirety.

FIELD

Apparatuses and methods consistent with exemplary embodiments relate to a turbine blade of a gas turbine and, more particularly, to a turbine blade cooling structure capable of improving cooling efficiency of a trailing edge of a turbine blade.

BACKGROUND

A turbine is a mechanical device that obtains a rotational force by an impulsive force or reaction force using a flow of a compressible fluid such as steam or gas. The turbine includes a steam turbine using a steam and a gas turbine using a high temperature combustion gas.

The gas turbine includes a compressor, a combustor, and a turbine. The compressor includes an air inlet into which air is introduced, and a plurality of compressor vanes and compressor blades which are alternately arranged in a compressor casing.

The combustor supplies fuel to the compressed air compressed in the compressor and ignites a fuel-air mixture with a burner to produce a high temperature and high pressure combustion gas.

The turbine includes a plurality of turbine vanes and turbine blades disposed alternately in a turbine casing. Further, a rotor is arranged passing through center of the compressor, the combustor, the turbine and an exhaust chamber.

The rotor is rotatably supported at both ends thereof by bearings. A plurality of disks are fixed to the rotor and the plurality of blades are coupled to corresponding disks, respectively. A driving shaft of a generator is connected to an end of the rotor that is adjacent to the exhaust chamber.

The gas turbine does not have a reciprocating mechanism such as a piston which is usually provided in a four-stroke engine. That is, the gas turbine has no mutual frictional parts such as a piston-cylinder mechanism, thereby having advantages in that consumption of lubricant is extremely small, an amplitude of vibration as a characteristic of a reciprocating machine is greatly reduced, high speed operation is possible.

Briefly describing the operation of the gas turbine, the compressed air compressed by the compressor is mixed with fuel and combusted to produce a high-temperature combustion gas, which is then injected toward the turbine. The injected combustion gas passes through the turbine vanes and the turbine blades to generate a rotational force by which the rotor is rotated.

The factors that affect the efficiency of gas turbines vary widely. Recent development of gas turbines has been progressing in various aspects such as improvement of combustion efficiency in a combustor, improvement of thermodynamic efficiency through an increase in turbine inlet temperature, and improvement of aerodynamic efficiency in a compressor and a turbine.

The types of industrial gas turbines for power generation can be classified depending upon turbine inlet temperature (TIT), currently G-class and H-class gas turbines are generally considered the highest class, and some of the newest gas turbines are rated to have reached the J-class. The higher the grade of the gas turbine, the higher both the efficiency and the turbine inlet temperature. H-class gas turbine has a turbine inlet temperature of 1,500° C., which necessitates the development of heat-resistant materials and cooling technologies.

Heat resistant design is required throughout gas turbines, which is particularly important in combustors and turbines where hot combustion gases are generated and flow. Gas turbines are cooled in an air-cooled scheme using compressed air produced by a compressor. In the case of a turbine, the cooling design is more difficult to obtain due to the complex structure in which turbine vanes are fixedly arranged between turbine blades rotating over several stages.

On the other hand, in the case of a turbine blade, a plurality of cooling holes and slots are formed to protect the turbine blade from a high temperature thermal stress environment. The cooling scheme of the turbine blade may include impingement cooling and film cooling systems based on cooling mechanism. The impingement cooling system uses a high pressure compressed air that directly impinges a high-temperature target surface for cooling, whereas the film cooling system uses an air film with very low thermal conductivity that forms on a target surface exposed to a high-temperature environment to cool the target surface while suppressing heat transfer to the target surface from the high-temperature environment. Composite cooling is also performed in the turbine blade to provide impingement cooling on an inner surface and film cooling on an outer surface, thereby protecting the turbine blade from high temperature environment.

Even in these cooling designs, the turbine blade is one of the most frequently damaged components because the turbine blade rotates in a high-temperature and high-pressure environment. In particular, a trailing edge of the turbine blade is thermally and structurally vulnerable due to insufficient supply of cooling fluid and pressure field fluctuations due to external shocks and wakes due to thin airfoil shape. On the other hand, if a cooling passage is configured inside the trailing edge for sufficient cooling, the thickness of the trailing edge increases, resulting in aerodynamic loss due to wake generation.

As described above, there are several constraints in order to achieve both sufficient cooling performance and aerodynamic performance at the trailing edge of the turbine blade, so it is necessary to develop a new trailing edge cooling structure to solve this problem.

SUMMARY

Aspects of one or more exemplary embodiments provide a trailing edge cooling structure that can secure sufficient cooling efficiency without sacrificing aerodynamic performance for the thermally and structurally vulnerable trailing edge of a turbine blade.

Additional aspects will be set forth in part in the description which follows and, in part, will become apparent from the description, or may be learned by practice of the exemplary embodiments.

According to an aspect of an exemplary embodiment, there is provided a cooling structure for a trailing edge of a turbine blade including an airfoil shaped blade part including a leading edge, a trailing edge, a pressure surface and a suction surface connecting the leading edge and the trailing edge, and a cavity channel formed in the blade part and through which a cooling fluid flows, the cooling structure including: slots and lands arranged alternately on the trailing edge along a span direction of the pressure surface by cutting a portion of the pressure surface, the slots communicating with the cavity channel and defined by adjacent lands where the pressure surface remains, wherein a pin-fin structure is disposed in the cavity channel on an upstream side of the slot, wherein the cooling fluid is introduced through a micro-channel formed inside the pin-fin structure and is discharged through film cooling holes formed in the pressure surface.

The pin-fin structure may introduce the cooling fluid flowing through the cavity channel into the micro-channel.

The pin-fin structure may introduce the cooling fluid into the micro-channel through a cooling fluid channel formed inside the suction surface.

The film cooling holes may be disposed along extension lines of the lands.

The film cooling holes may be disposed in multiple rows along the trailing edge, and the multiple rows may include first to n-th rows spaced apart from each other in a direction toward the leading edge.

Each of the film cooling holes arranged in the first row may be disposed along extension lines of the lands, and each of the film cooling holes arranged in subsequent rows of the first row may be alternated with respect to the film cooling holes of a preceding row.

The film cooling holes arranged in respective row may be all disposed along the extension lines of the lands.

The micro-channel in the pin-fin structure may be provided with a concave-convex structure.

The micro-channel in the pin-fin structure may be provided with a spiral flow path.

The micro-channel in the pin-fin structure may be provided with a coil.

An impingement jet space may be formed inside the pressure surface connecting the micro-channel in the pin-fin structure and the film cooling holes.

According to an aspect of another exemplary embodiment, there is provided a turbine engine including: a compressor configured to compress external air; a combustor configured to mix fuel with air compressed by the compressor and combust a mixture of the fuel and the compressed air; and a turbine comprising a plurality of turbine blades rotated by combustion gas discharged from the combustor, wherein each of the turbine blades includes an airfoil shape blade part including a leading edge, a trailing edge, a pressure surface and a suction surface connecting the leading edge and the trailing edge, and a cavity channel formed in the blade part and through which a cooling fluid flows, wherein the trailing edge of the turbine blade is provided with a cooling structure including: slots and lands arranged alternately along a span direction of the pressure surface by cutting a portion of the pressure surface, the slots communicating with the cavity channel and defined by adjacent lands where the pressure surface remains, wherein a pin-fin structure is disposed in the cavity channel on an upstream side of the slot, wherein the cooling fluid is introduced through a micro-channel formed inside the pin-fin structure and is discharged through film cooling holes formed in the pressure surface.

According to one or more exemplary embodiments, the trailing edge cooling structure improves the cooling performance. The lands are protected from exposure to high-temperature gas by the cutout shape of the trailing edge where the micro-channel of the pin-fin structure and the film cooling holes are disposed, and the contact area between the cooling fluid and the cutout surface increases, so that the film cooling efficiency on the cutout surface is improved. In addition, the heat transfer area inside the trailing edge of the turbine blade increases through the micro-channel, the film cooling holes, and the impingement jet space, thereby improving the internal cooling performance as well.

Further, according to the trailing edge cooling structure of the turbine blade, the vortex shedding phenomenon is reduced. In the cutout surface with film cooling holes, flow stagnant regions and shear layers are not substantially formed and vortex shedding hardly occurs. Therefore, the cooling performance can be prevented from being deteriorated because the hot gas and the cooling fluid are not mixed and the cooling fluid is evenly sprayed up to the downstream of the cutout surface.

In addition, according to one or more exemplary embodiments, the aerodynamic performance of the turbine blade may also be improved. The cutout shape having the micro-channel of the pin-fin structure and the film cooling holes may improve the cooling performance of the trailing edge. Based on this, the thickness of the trailing edge can be made thinner, and aerodynamic losses can be greatly reduced by reducing the thickness of the trailing edge to reduce the occurrence of wakes.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
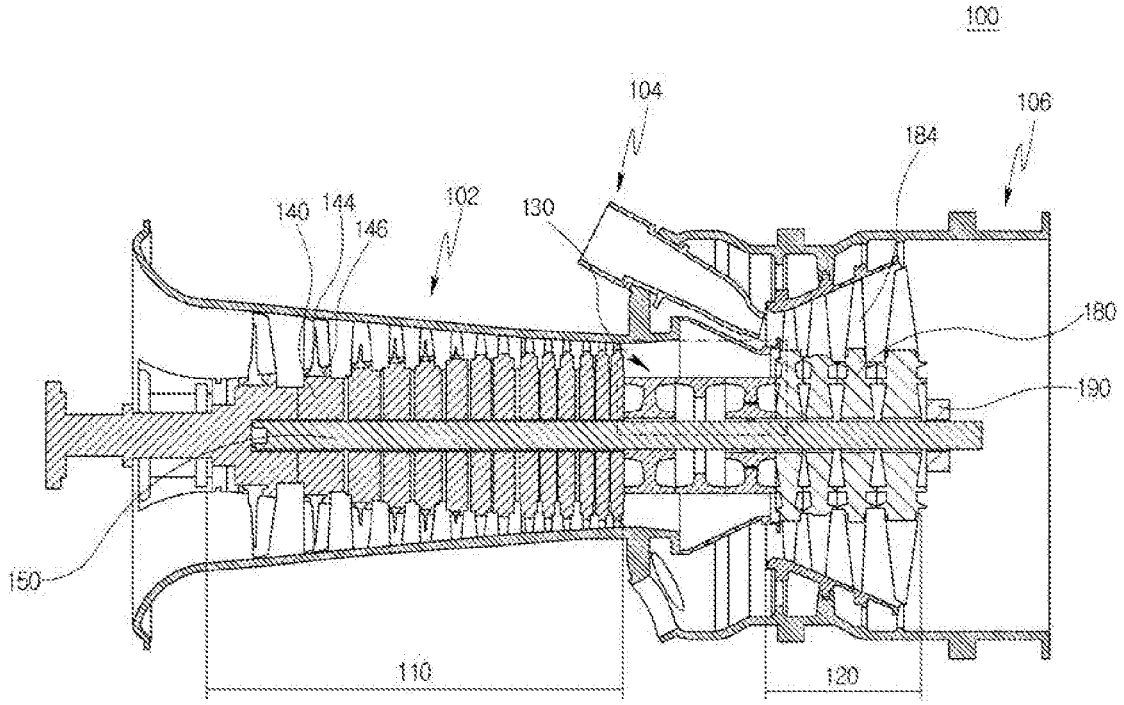
FIG. 1 is a cross-sectional view illustrating an overall configuration of a gas turbine to which a cooling structure for a trailing edge of a turbine blade can be applied according to an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Terms used herein are for the purpose of describing specific embodiments only and are not intended to limit the scope of the disclosure. As used herein, an element expressed as a singular form includes a plurality of elements, unless the context clearly indicates otherwise. Further, terms such as "comprising" or "including" should be construed as designating that there are such feature, number, step, operation, element, part, or combination thereof, not to exclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the different drawings and exemplary embodiments. In certain embodiments, a detailed description of known functions and configurations well known in the art will be omitted to avoid obscuring appreciation of the disclosure by a person of ordinary skill in the art. For the same reason, some elements are exaggerated, omitted, or schematically illustrated in the accompanying drawings.

FIG. 1 is a cross-sectional view illustrating an overall configuration of a gas turbine to which a cooling structure for a trailing edge of a turbine blade can be applied according to an exemplary embodiment. Referring to FIG. 1, a gas turbine 100 includes a housing 102 and a diffuser 106 disposed behind the housing 102 to discharge a combustion gas passing through a turbine. A combustor 104 is disposed in front of the diffuser 106 to combust compressed air supplied thereto.

Based on the flow direction of the air, a compressor section 110 is located at an upstream side, and a turbine section 120 is located at a downstream side. A torque tube 130 serving as a torque transmission member to transmit the rotational torque generated in the turbine section 120 to the compressor section 110 is disposed between the compressor section 110 and the turbine section 120.

The compressor section 110 includes a plurality of compressor rotor disks 140, each of which is fastened by a tie rod 150 to prevent axial separation in an axial direction of the tie rod 150.

For example, the compressor rotor disks 140 are axially arranged in a state in which the tie rod 150 constituting a rotary shaft passes through centers of the compressor rotor disks 140. Here, neighboring compressor rotor disks 140 are disposed so that facing surfaces thereof are in tight contact with each other by being pressed by the tie rod 150. The neighboring compressor rotor disks 140 cannot rotate because of this arrangement.

A plurality of blades 144 are radially coupled to an outer circumferential surface of the compressor rotor disk 140. Each of the compressor blades 144 has a root portion 146 which is fastened to the compressor rotor disk 140.

A plurality of compressor vanes are fixedly arranged between each of the compressor rotor disks 140 in the housing 102. While the compressor rotor disks 140 rotate along with a rotation of the tie rod 150, the compressor vanes fixed to the housing 102 do not rotate. The compressor vane guides a flow of compressed air moved from front-stage compressor blades 144 of the compressor rotor disk 140 to rear-stage compressor blades 144 of the compressor rotor disk 140. Here, terms "front" and "rear" may refer to relative positions determined based on the flow direction of compressed air.

A coupling scheme of the root portion 146 which are coupled to the compressor rotor disks 140 is classified into a tangential type and an axial type. These may be chosen according to the required structure of the commercial gas turbine, and may have a dovetail shape or fir-tree shape. In some cases, the compressor blade 144 may be coupled to the compressor rotor disk 140 by using other types of fasteners such as keys or bolts.

The tie rod 150 is arranged to pass through centers of the compressor rotor disks 140 such that one end thereof is fastened to the most upstream compressor rotor disk and the other end thereof is fastened by a fixing nut 190.

It is understood that the shape of the tie rod 150 is not limited to the example illustrated in FIG. 1, and may have a variety of structures depending on the gas turbine. For example, a single tie rod may be disposed to pass through central portions of the rotor disks, a plurality of tie rods may be arranged circumferentially, or a combination thereof may be used.

Also, a deswirler serving as a guide vane may be installed at the rear stage of the diffuser in order to adjust a flow angle of a pressurized fluid entering a combustor inlet to a designed flow angle.

The combustor 104 mixes the introduced compressed air with fuel, combusts the air-fuel mixture to produce a high-temperature and high-pressure combustion gas, and increases the temperature of the combustion gas to the heat resistance limit that the combustor and the turbine components can withstand through an isobaric combustion process.

A plurality of combustors constituting the combustor 104 may be arranged in the casing in a form of a cell. Each of the combustors includes a burner having a fuel injection nozzle and the like, a combustor liner forming a combustion chamber, and a transition piece as a connection between the combustor and the turbine.

The combustor liner provides a combustion space in which the fuel injected by the fuel injection nozzle is mixed with the compressed air supplied from the compressor and the fuel-air mixture is combusted. The combustor liner may include a flame canister providing a combustion space in which the fuel-air mixture is combusted, and a flow sleeve forming an annular space surrounding the flame canister. The fuel injection nozzle is coupled to a front end of the combustor liner, and an igniter is coupled to a side wall of the combustor liner.

The transition piece is connected to a rear end of the combustor liner to transmit the combustion gas to the turbine. An outer wall of the transition piece is cooled by the compressed air supplied from the compressor to prevent the transition piece from being damaged by the high temperature combustion gas.

To this end, the transition piece is provided with cooling holes through which compressed air is injected into and cools inside of the transition piece and flows towards the combustor liner.

The compressed air that has cooled the transition piece flows into the annular space of the combustor liner and is supplied as a cooling air to an outer wall of the combustor liner from the outside of the flow sleeve through cooling holes provided in the flow sleeve so that air flows may collide with each other.

The high-temperature and high-pressure combustion gas ejected from the combustor 104 is supplied to the turbine section 120. The supplied high-temperature and high-pressure combustion gas expands and collides with and provides a reaction force to rotating blades of the turbine to generate a rotational torque. A portion of the rotational torque is transmitted to the compressor section through the torque tube, and remaining portion which is an excessive torque is used to drive a generator or the like.

The turbine section 120 is basically similar in structure to the compressor section 110. That is, the turbine section 120 also includes a plurality of turbine rotor disks 180 similar to the compressor rotor disks of the compressor section. Thus, the turbine rotor disk 180 also includes a plurality of turbine blades 184 disposed radially. The turbine blade 184 may also be coupled to the turbine rotor disk 180 in a dovetail coupling manner. Between the turbine blades 184 of the turbine rotor disk 180, a plurality of vanes fixed to the housing are provided to guide a flow direction of the combustion gas passing through the turbine blades 184.

Figure 2A:
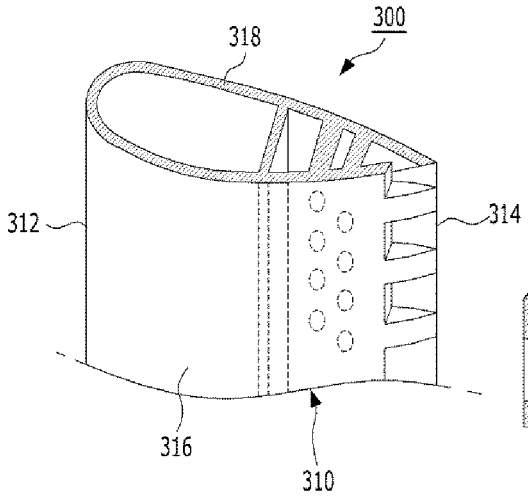
FIG.2A Related Art
FIGS. 2A and 2B are views illustrating a related art cutback structure formed on a trailing edge of a turbine blade.
Figure 2B:
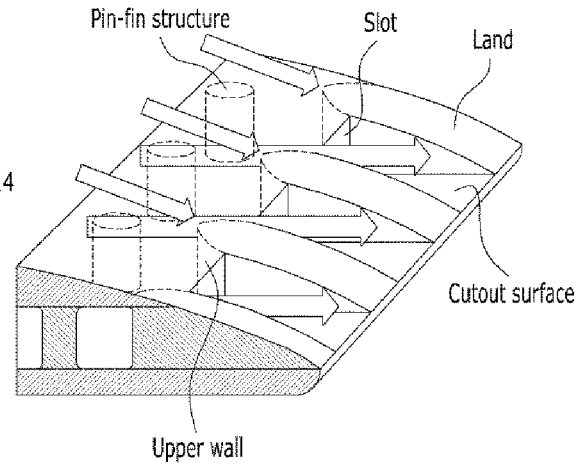
FIG.2B Related Art

FIGS. 2A and 2B illustrate a related art cutback structure for improving cooling performance at a trailing edge of a turbine blade. Recently developed turbine blades often have a trailing edge formed in a form of a cutout. As illustrated in FIGS. 2A and 2B, the cutout refers to a shape in which a suction surface is exposed by cutting a part of the trailing edge of a pressure surface of the blade, and the cutout part is formed as a slot communicating with a cavity channel in the blade. A turbine blade 300 includes an airfoil shaped blade part 310 including a leading edge 312, a trailing edge 314, a pressure surface 316 and a suction surface 318 connecting the leading edge 312 and the trailing edge 314.

The slot includes a plurality of slots each defined by adjacent uncut lands and into which cooling fluid is sprayed towards the trailing edge to cool the trailing edge. The cutout shape improves cooling performance and allows for a thinner design than a simple trailing edge shape including an internal cooling passage of a cavity channel, thereby reducing aerodynamic loss.

However, in the cutout shape of FIGS. 2A and 2B, a wall section is provided on an upper side of the slots. On a rear side of the wall section, a flow stagnant region and a shear layer are formed, resulting in vortex shedding, which causes a mixture of hot gas and cooling fluid to reduce cooling performance in the region downstream of the cutout surface. In addition, the surface of the land constituting a side wall of the slot is exposed to hot gas as it is and has a disadvantage that it is very vulnerable to heat.

The exemplary embodiment is to further improve the related art trailing edge cutout cooling structure as illustrated in FIGS. 2A and 2B and will be described in detail with reference to the accompanying drawings.

FIGS. 3A, 3B, 4A and 4B illustrate a basic configuration of a trailing edge cooling structure of a turbine blade (hereinafter referred to as a "trailing edge cooling structure") according to an exemplary embodiment. The turbine blade 300 includes an airfoil shaped blade part 310 including a leading edge 312 and a trailing edge 314, and a pressure surface 316 and a suction surface 318 connecting the leading edge 312 and the trailing edge 314. The blade part 310 has a cavity channel 320 through which a cooling fluid flows.

Referring to FIGS. 3A, 3B, 4A and 4B, similar to the cutout structure of FIGS. 2A and 2B, a portion of the pressure surface 316 of the trailing edge 314 is cutout along a span direction of the pressure surface 316 to form multiple slots 410. The slots 410 are defined by adjacent lands 412 that constitute the pressure surface 316 in communication with the cavity channel 320 inside the turbine blade 300 to discharge the cooling fluid therethrough, thereby forming an alternating structure of the slots 410 and lands 412.

A pin-fin structure 420 is disposed inside the cavity channel 320 on an upstream side of the slot 410. The pin-fin structure 420 is configured to generate a turbulent flow component in the cooling fluid discharged through the slot 410, thereby improving cooling performance. The pin-fin structure 420 also serves to improve the structural strength of the thin trailing edge 314.

In addition, according to the exemplary embodiment, the pin-fin structure 420 is formed with a hollow structure having a micro-channel 422. A cooling fluid is introduced into the micro-channel 422 inside the pin-fin structure 420. Here, the upstream side is a flow of combustion gas that flows from the leading edge 312 to the trailing edge 314 of the turbine blade 300, or flows through the cavity channel 320 inside the turbine blade 300 to the slot 410 of the trailing edge 314. Unless otherwise specified, the upstream side indicates the leading edge 312 side.

Then, the cooling fluid introduced into the micro-channel 422 is discharged through film cooling holes 430 formed in the surface of the pressure surface 316. Compared with the related art of FIG. 2 the exemplary embodiment is characterized by the structure in which the cooling fluid is supplied to the film cooling holes 430 in the pressure surface 316 through the micro-channel 422 inside the pin-fin structure 420. The cooling fluid exiting through the film cooling holes 430 causes film cooling in a cutout 400 structure of the trailing edge 314. In the related art, the film cooling effect can be obtained only on the sidewalls of the slot 410 and a cutout surface 414, but in the exemplary embodiment, the film cooling effect can also be obtained on the surface near the upper walls of the slots 410 and the lands 412 constituting the sidewalls of the slots 410 by providing the film cooling holes 430 disposed on the upstream side of the cutout 400.

For example, according to the exemplary embodiment, the pin-fin structure 420 disposed in the cavity channel 320 has the hollow structure with the micro-channel 422 formed as a supply path to the film cooling holes 430. Therefore, it is possible to secure a supply path for supplying the cooling fluid to the film cooling holes 430 without increasing a thickness of the trailing edge 314 which is advantageous in aerodynamic performance as it is thinner. In addition, as the micro-channel 422 inside the pin-fin structure 420 forms an additional heat transfer surface, the heat transfer area inside the trailing edge 314 increases, thereby improving the internal cooling performance.

Figure 3A:
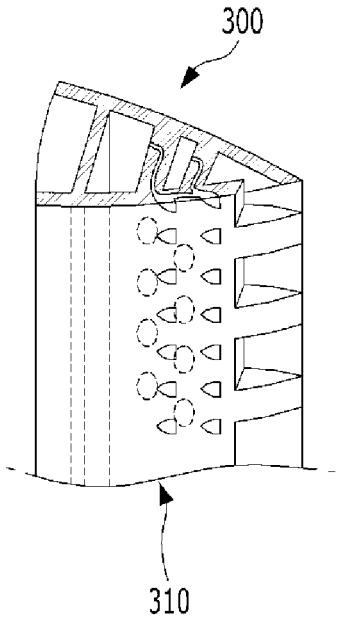
FIGS. 3A, 3B, 4A and 4B are views illustrating a basic configuration of the trailing edge cooling structure according to an exemplary embodiment.
Figure 3B:
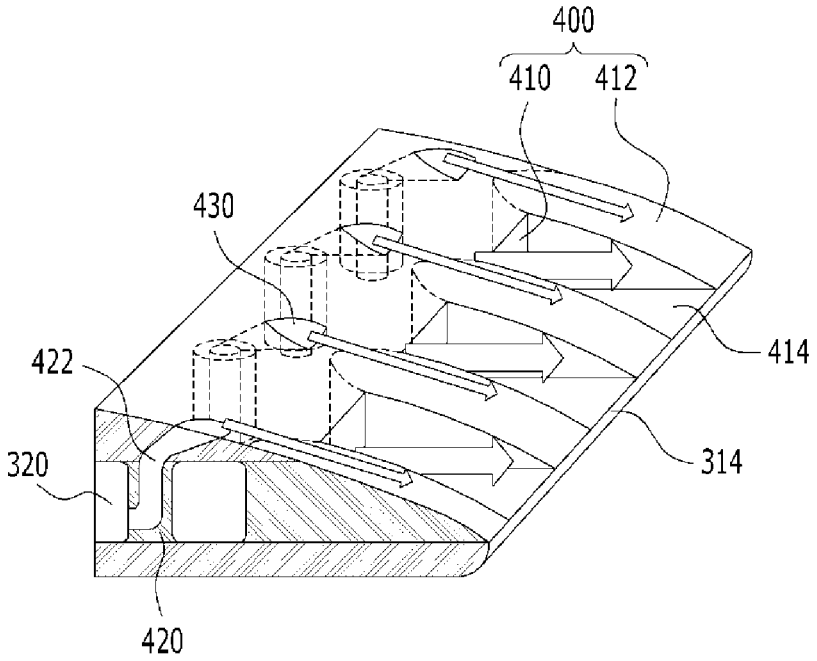
Figure 4A:
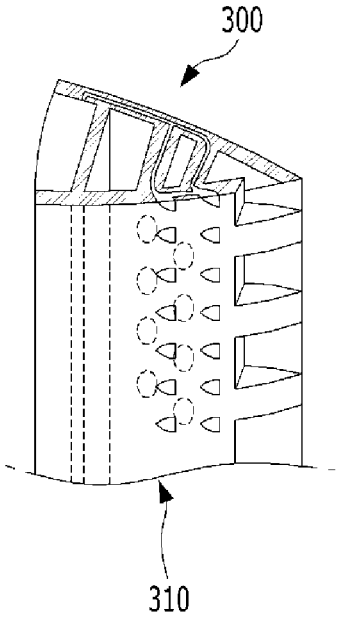
Figure 4B:
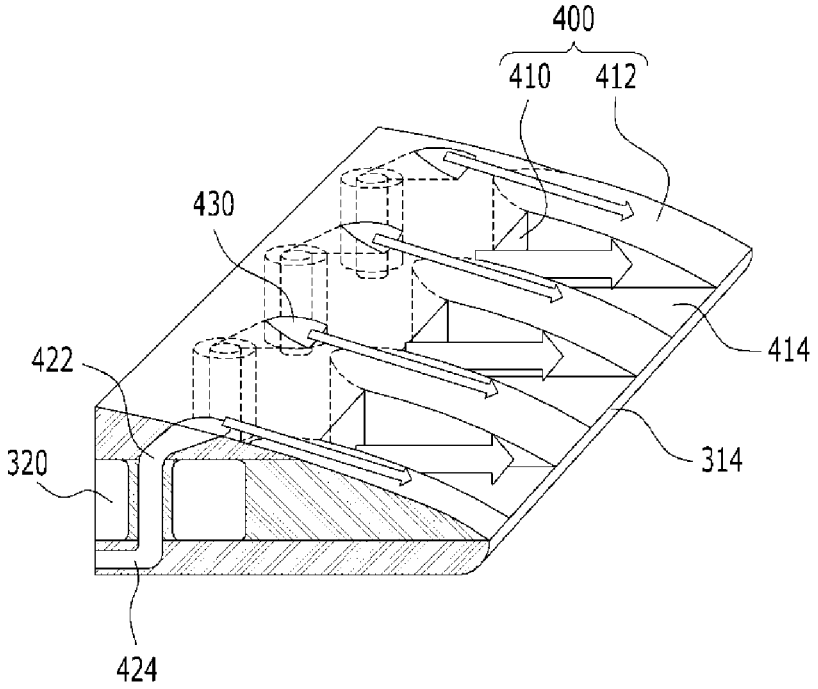

FIGS. 3A, 3B, 4A and 4B illustrate exemplary embodiments of introducing a cooling fluid into the micro-channel 422 inside the pin-fin structure 420. FIGS. 3A and 3B illustrate a configuration in which the cooling fluid flowing through the cavity channel 320 is directly introduced into the micro-channel 422. For example, an inlet of the micro-channel 422 is formed on one side of the pin-fin structure 420 facing a flow of the cooling fluid flowing through the cavity channel 320 to introduce the cooling fluid into the pin-fin structure 420. FIGS. 4A and 4B illustrate a configuration in which the cooling fluid is introduced into the micro-channel 422 through separate cooling fluid channels 424 formed inside the suction surface 318. Here, because a portion of the cooling fluid directed to the slots 410 of the trailing edge 314 is not drawn into the micro-channel 422, it is advantageous to ensure sufficient cooling performance at the cutout surface 414 even though the structure is somewhat complicated.

Referring to FIGS. 3A, 3B, 4A and 4B, the film cooling hole 430 upstream of the cutout structure 400 is disposed along an extension line of the land 412. This arrangement of the film cooling hole 430 is because the surface of the land 412 constituting the sidewall of the slot 410 in the cutout structure 400 is thermally very vulnerable as it is completely exposed to hot gas, so that the film cooling hole 430 is arranged such that a constant film cooling effect appears in the land 412, which is the most problematic in cooling. Although cooling of the surface of the land 412 is the most important, the film cooling holes 430 may be arranged in multiple rows to implement various cooling effects.

Figure 5:
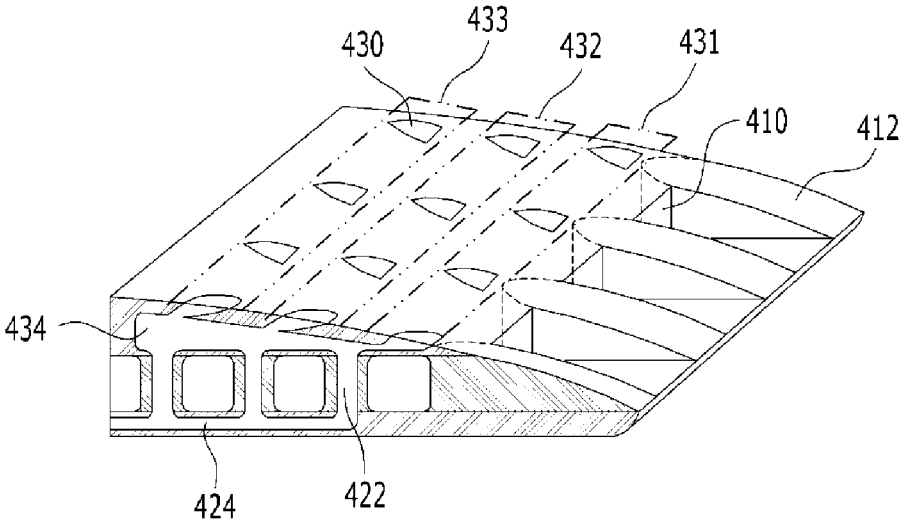
FIGS. 5 and 6 are views illustrating a configuration of impingement cooling holes arranged in rows according to an exemplary embodiment.
Figure 6:
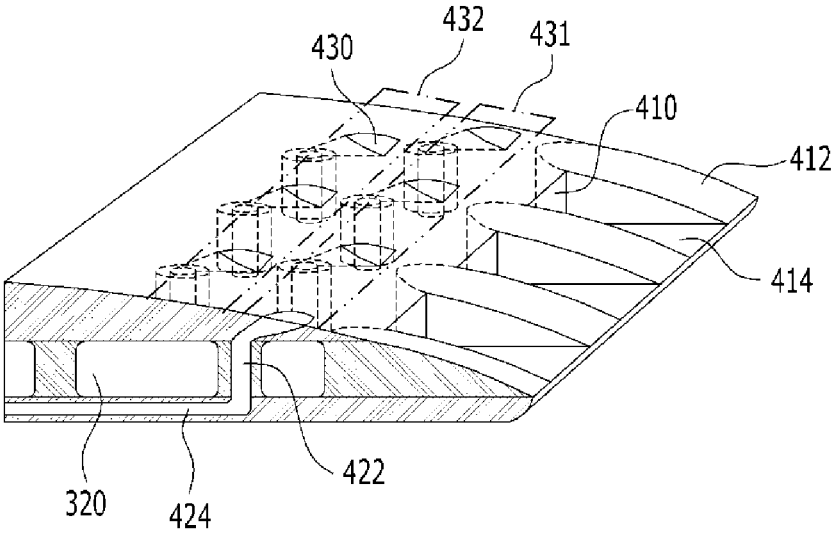

FIGS. 5 and 6 illustrate exemplary embodiments when the film cooling holes 430 are arranged in multiple rows. For example, the film cooling holes 430 form respective rows along the span direction of the trailing edge 314, wherein the multiple rows include first to n-th rows 431, 432, . . . (where n is a natural number) sequentially arranged at appropriate intervals in a direction from the trailing edge 314 toward the leading edge 312.

FIG. 5 illustrates a configuration in which the film cooling holes 430 are arranged in first to third rows 431, 432, and 433, and FIG. 6 illustrates a configuration in which the film cooling holes 430 are arranged in first and second rows 431 and 432. It is understood that the number of rows of the film cooling holes 430 may not be limited to the example illustrated in FIGS. 5 and 6, and may be changed or vary according to design conditions.

Referring to FIG. 5, individual film cooling holes 430 arranged in each row are all arranged along the extension lines of the lands 412. This may be advantageous in reliably cooling the surface of the land 412 directly exposed to the hot gas in the cutout structure 400.

Referring to FIG. 6, each of the film cooling holes 430 arranged in the first row 431 is disposed along extension lines of the lands 412, and each of the film cooling holes 430 arranged in subsequent rows of the first row is disposed alternately between adjacent rows. The film cooling holes 430 in the first row 431 closest to the trailing edge 314 serve to cool the surface of the land 412 exposed to the hot gas, and the film cooling holes 430 alternately arranged at a half pitch (i.e., a half of a distance between lands) in the subsequent rows serve to suppress the mixing of the hot gas and the cooling fluid by formation of a shear layer and an occurrence of vortex shedding on the cutout surface 414. This alternated arrangement of the film cooling holes 430 may be advantageous in harmoniously improving the cooling performance and the aerodynamic performance at the trailing edge 314.

Figure 7:
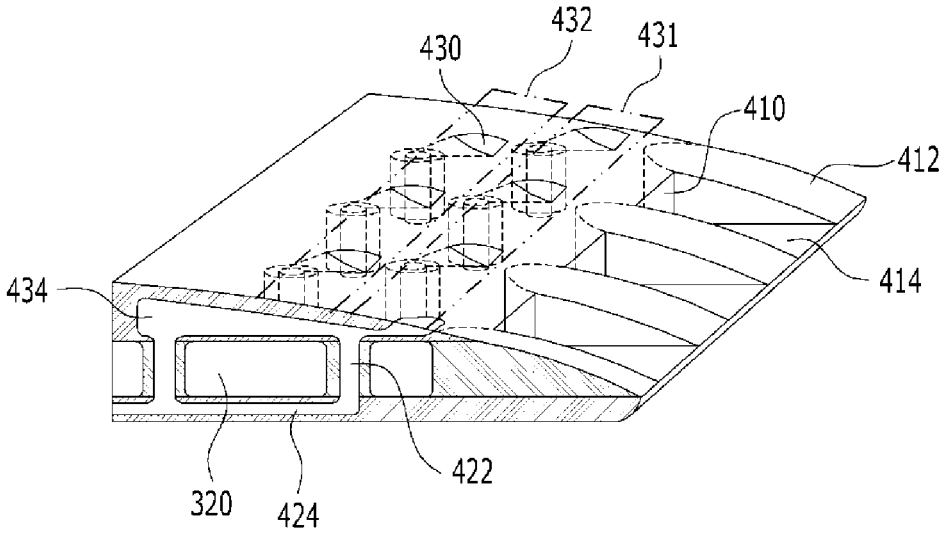
FIG. 7 is a view illustrating an exemplary embodiment in which an impingement jet space is formed inside a pressure surface.
Figure 8:
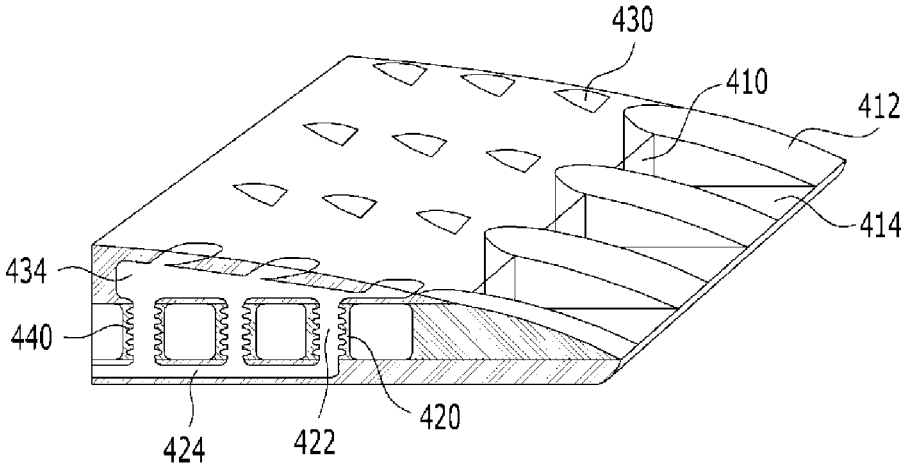
FIGS. 8 to 10 are views illustrating various exemplary embodiments of a micro-channel provided in a pin-fin structure.
Figure 9:
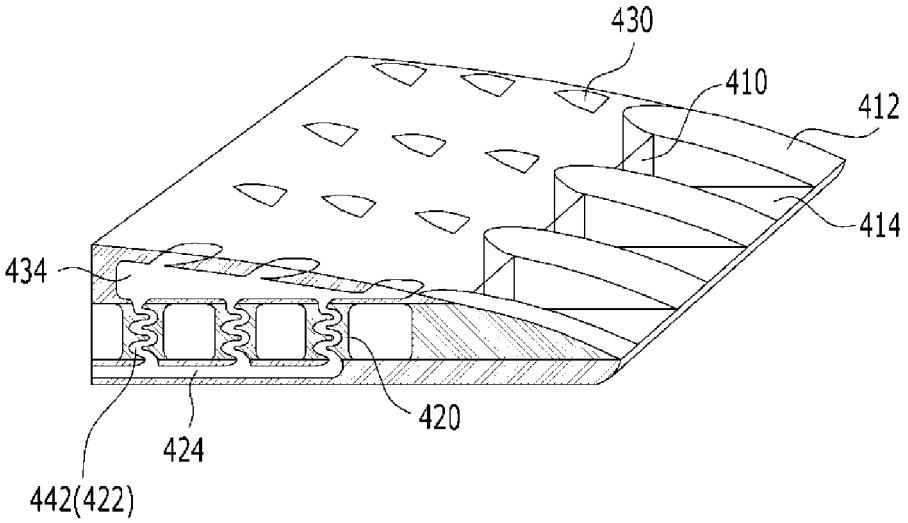
Figure 10:
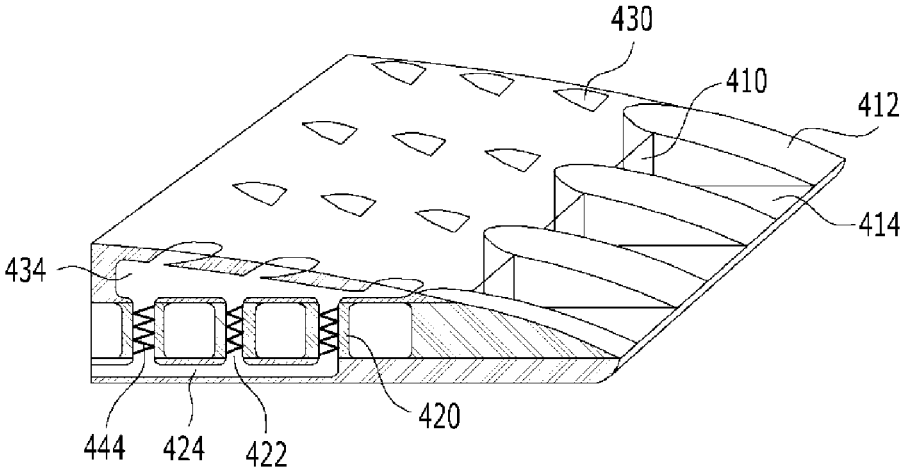

FIGS. 7 to 10 illustrate exemplary embodiments which can improve the internal cooling performance of the trailing edge 314 as well as the cooling performance and/or aerodynamic performance at the surface of the trailing edge 314 having the cutout structure 400. FIG. 7 is a view illustrating an exemplary embodiment in which an impingement jet space is formed inside a pressure surface. FIGS. 8 to 10 are views illustrating various exemplary embodiments of a micro-channel provided in a pin-fin structure.

FIGS. 8 to 10 illustrate various configurations that can improve heat transfer efficiency inside the hollow pin-fin structure 420. Because both ends of the pin-fin structure 420 are bonded or connected to the pressure surface 316 and the suction surface 318, when heat dissipation in the pin-fin structure 420 is promoted, the cooling performance in the region of the trailing edge 314 is also improved.

FIG. 8 illustrates a configuration in which a micro-channel 422 inside a pin-fin structure 420 is provided with a concave-convex structure 440, FIG. 9 illustrates a configuration in which a micro-channel 422 inside a pin-fin structure 420 is formed with a spiral flow path 442, and FIG. 10 illustrates a configuration in which a coil 444 is inserted into the micro-channel 422 of the pin-fin structure 420 to improve the heat transfer effect.

FIG. 7 illustrates a configuration in which an impingement cooling effect is provided to the inside of the trailing edge 314. The exemplary embodiments of FIGS. 8 to 10 may be applied in combination to the trailing edge cooling structure of FIG. 7. Referring to FIG. 7, an impingement jet space 434 is formed inside the pressure surface 316 connecting the micro-channel 422 and the film cooling hole 430 in the pin-fin structure 420. The cooling fluid injected through the micro-channel 422 of the pin-fin structure 420 impinges against the impingement jet space 434 to cool the pressure surface 316 as an impingement jet, and subsequently flows out of the film cooling hole 430 to perform the film cooling. Accordingly, the impingement jet space 434 also contributes to the internal cooling performance of the trailing edge 314.

On the other hand, the trailing edge cooling structure according to one or more exemplary embodiments may be applied to the turbine engine 100 illustrated in FIG. 1.

For example, in the trailing edge cooling structure provided in the turbine engine 100, the slots 410 and the lands 412 are alternately arranged along the span direction of the pressure surface 316 of the trailing edge 314 of the turbine blade 300, and the pin-fin structure 420 is disposed in the cavity channel 320 on the upstream side of the slot 410. The cooling fluid is introduced through the micro-channel 422 formed in the pin-fin structure 420, and then flows out of the film cooling holes 430 formed in the pressure surface 316.

While one or more exemplary embodiments have been described with reference to the accompanying drawings, it is to be apparent to those skilled in the art that various modifications and variations in form and details can be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A cooling structure comprising:

an airfoil shaped blade part including a leading edge, a trailing edge, a pressure surface and a suction surface connecting the leading edge and the trailing edge, a cavity channel formed in the blade part and through which a cooling fluid flows, slots and lands arranged alternately on the trailing edge along a span direction of the pressure surface by cutting a portion of the pressure surface, the slots communicating with the cavity channel and defined by adjacent lands where the pressure surface remains, wherein a pin-fin structure is disposed in the cavity channel on an upstream side of the slot, wherein the cooling fluid is introduced through a micro channel formed inside the pin-fin structure and is discharged through film cooling holes formed in the pressure surface, wherein an impingement jet space is formed inside the pressure surface connecting the micro-channel in the pin-fin structure and the film cooling holes, and wherein a cross-sectional area of the impingement jet space decreases from a closed upstream end to a downstream end.

2. The cooling structure according to claim 1, wherein the cooling fluid flowing through the cavity channel flows into the micro-channel.

3. The cooling structure according to claim 1, wherein the cooling fluid flows into the micro channel through a cooling fluid channel formed inside the suction surface.

4. The cooling structure according to claim 1, wherein the film cooling holes are disposed along extension lines of the lands.

5. The cooling structure according to claim 1, wherein the film cooling holes are disposed in multiple rows along the trailing edge, wherein the multiple rows include first to n-th rows spaced apart from each other in a direction toward the leading edge.

6. The cooling structure according to claim 5, wherein each of the film cooling holes arranged in the first row is disposed along extension lines of the lands, and each of the film cooling holes arranged in subsequent rows of the first row is alternated with respect to the film cooling holes of a preceding row.

7. The cooling structure according to claim 5, wherein the film cooling holes arranged in respective row are all disposed along the extension lines of the lands.

8. The cooling structure according to claim 1, wherein the micro-channel in the pin-fin structure is provided with a concave-convex structure.

9. The cooling structure according to claim 1, wherein the micro-channel in the pin-fin structure is provided with a spiral flow path.

10. The cooling structure according to claim 1, wherein the micro-channel in the pin-fin structure is provided with a coil.

11. A turbine engine comprising:

a compressor configured to compress external air;

a combustor configured to mix fuel with air compressed by the compressor and combust a mixture of the fuel and the compressed air; and a turbine comprising a plurality of turbine blades rotated by combustion gas discharged from the combustor, wherein each of the turbine blades comprises an airfoil shaped blade part including a leading edge, a trailing edge, a pressure surface and a suction surface connecting the leading edge and the trailing edge, and a cavity channel formed in the blade part and through which a cooling fluid flows, wherein the trailing edge of the turbine blade is provided with a cooling structure comprising: slots and lands arranged alternately along a span direction of the pressure surface by cutting a portion of the pressure surface, the slots communicating with the cavity channel and defined by adjacent lands where the pressure surface remains, wherein a pin-fin structure is disposed in the cavity channel on an upstream side of the slot, wherein the cooling fluid is introduced through a micro-channel formed inside the pin-fin structure and is discharged through film cooling holes formed in the pressure surface, wherein an impingement jet space is formed inside the pressure surface connecting the micro-channel in the pin-fin structure and the film cooling holes, and wherein a cross-sectional area of the impingement jet space decreases from a closed upstream end to a downstream end.

12. The turbine engine according to claim 11, wherein the cooling fluid flowing through the cavity channel flows into the micro-channel, or the cooling fluid flows into the micro-channel through a cooling fluid channel formed inside the suction surface.

13. The turbine engine according to claim 11, wherein the film cooling holes are disposed along extension lines of the lands.

14. The turbine engine according to claim 11, wherein the film cooling holes are disposed in multiple rows along the trailing edge, wherein the multiple rows include first to n-th rows spaced apart from each other in a direction toward the leading edge.

15. The turbine engine according to claim 14, wherein each of the film cooling holes arranged in the first row is disposed along extension lines of the lands, and each of the film cooling holes arranged in subsequent rows of the first row is alternated with respect to the film cooling holes of a preceding row.

16. The turbine engine according to claim 14, wherein the film cooling holes arranged in respective row are all disposed along the extension lines of the lands.

17. The turbine engine according to claim 11, wherein the micro-channel in the pin-fin structure is provided with a concave-convex structure, a spiral flow path, or a coil.

18. The turbine engine according to claim 17, wherein an impingement jet space is formed inside the pressure surface connecting the micro-channel in the pin-fin structure and the film cooling holes.

* * * * *